US011217381B2

(12) United States Patent
Li et al.

(10) Patent No.: US 11,217,381 B2
(45) Date of Patent: Jan. 4, 2022

(54) COIL COMPONENT

(71) Applicant: SAMSUNG ELECTRO-MECHANICS CO., LTD., Suwon-si (KR)

(72) Inventors: Yong Hui Li, Suwon-si (KR); Byung Soo Kang, Suwon-si (KR); Jae Hun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 581 days.

(21) Appl. No.: 16/178,003

(22) Filed: Nov. 1, 2018

(65) Prior Publication Data

US 2019/0333684 A1 Oct. 31, 2019

(30) Foreign Application Priority Data

Apr. 25, 2018 (KR) ..... 10-2018-0047656

(51) Int. Cl.
*H01F 27/28* (2006.01)
*H01F 27/32* (2006.01)
(Continued)

(52) U.S. Cl.
CPC ..... *H01F 27/2828* (2013.01); *H01F 27/22* (2013.01); *H01F 27/28* (2013.01);
(Continued)

(58) Field of Classification Search
CPC .. H01F 27/2828; H01F 27/327; H01F 27/306; H01F 2017/048; H01F 27/022; H01F 27/292; H01F 17/0013; H01F 17/04; H01F 27/28; H01F 27/323; H01F 27/2804; H01F 27/324; H01F 2017/0073; H01F 2017/002
See application file for complete search history.

(56) References Cited

U.S. PATENT DOCUMENTS 10,515,750 B2 * 12/2019 Jeong ..... H01F 41/046
2013/0249662 A1 * 9/2013 Noyama ..... H01F 17/0013 336/200
(Continued)

FOREIGN PATENT DOCUMENTS

CN 104810132 A 7/2015
CN 105097187 A 11/2015
(Continued)

OTHER PUBLICATIONS

First Office Action dated Sep. 24, 2020 in Chinese Patent Application No. 201910090362.7 (English translation).

*Primary Examiner* — Tuyen T Nguyen
(74) *Attorney, Agent, or Firm* — Morgan, Lewis & Bockius LLP

(57) ABSTRACT

A coil component includes: a body including a support member including a through-hole and a via hole spaced apart from the through-hole, an internal coil supported by the support member and including a plurality of conductive units wound in one direction, and an encapsulant encapsulating the support member and the internal coil and filling the through-hole; and an external electrode disposed on an external surface of the body and connected to the internal coil.

20 Claims, 4 Drawing Sheets

(51) Int. Cl.
*H01F 27/30* (2006.01)
*H01F 27/29* (2006.01)
*H01F 27/22* (2006.01)

(52) U.S. Cl.
CPC ..... *H01F 27/292* (2013.01); *H01F 27/306* (2013.01); *H01F 27/327* (2013.01)

(56) References Cited

U.S. PATENT DOCUMENTS

| | | | | |
|---|---|---|---|---|
| 2013/0265131 | A1* | 10/2013 | Yang ..... | H01F 17/0013 336/192 |
| 2013/0300529 | A1 | 11/2013 | Chang et al. | |
| 2015/0340149 | A1 | 11/2015 | Lee et al. | |
| 2016/0086719 | A1 | 3/2016 | Jeong | |
| 2016/0111195 | A1 | 4/2016 | Nishyama | |
| 2016/0307689 | A1 | 10/2016 | Jeong et al. | |
| 2017/0358955 | A1 | 12/2017 | Feng et al. | |

FOREIGN PATENT DOCUMENTS

| | | | |
|---|---|---|---|
| CN | 107492436 | A | 12/2017 |
| JP | 3488869 | B2 | 1/2004 |
| JP | 2016-82016 | A | 5/2016 |
| KR | 10-1999-0066108 | A | 8/1999 |
| KR | 10-2016-0033464 | A | 3/2016 |
| KR | 10-2017-0088162 | A | 8/2017 |
| KR | 10-2017-0097864 | A | 8/2017 |

* cited by examiner

I - I'

COIL COMPONENT

CROSS-REFERENCE TO RELATED APPLICATION(S)

This application claims benefit of priority to Korean Patent Application No. 10-2018-0047656 filed on Apr. 25, 2018 in the Korean Intellectual Property Office, the disclosure of which is incorporated herein by reference in its entirety.

TECHNICAL FIELD

The present disclosure relates to a coil component, and more particularly, to a power inductor.

BACKGROUND

In accordance with the development of information technology (IT), apparatuses have been rapidly miniaturized and thinned. Therefore, market demand for small and thin devices has increased.

In accordance with such a technical trend, Korean Patent Laid-Open Publication No. 10-1999-0066108 provides a power inductor including a substrate having a via hole and coils disposed on opposite surfaces of the substrate and electrically connected to each other through the via hole of the substrate to make an effort to provide an inductor including coils having a uniform and wide aspect ratio.

In addition, in a design of the power inductor, an area of a core region in the coil may be generally narrow, and magnetic flux may be mainly concentrated in the core region in the coil. Therefore, there has been demand to optimize a flow of the magnetic flux through structural technology improvements of the core region in which the magnetic flux is concentrated.

SUMMARY

An aspect of the present disclosure may provide a coil component of which an inductance (Ls) and saturated current (Isat) characteristics may be improved by significantly increasing a magnetic material filling region of a core center.

According to an aspect of the present disclosure, a coil component may include: a body including a support member including a through-hole and a via hole spaced apart from the through-hole, an internal coil supported by the support member and including a plurality of conductive units wound in one direction, and an encapsulant encapsulating the support member and the internal coil and filling the through-hole; and an external electrode connected to the internal coil. The internal coil may include an upper coil disposed on one surface of the support member and a lower coil disposed on the other surface of the support member and may include a via portion connecting end portions of the upper and lower coils to each other and filling the via hole, and an outer boundary surface of a first conductive unit directly surrounding the via portion may include a protrusion portion protruding toward an external surface of the body.

Each of the plurality of conductive units may include linear portions and curved portions alternately disposed and connected to each other.

The via portion may be disposed in the curved portion of the plurality of conductive units.

The via portion may be embedded toward the protrusion portion of the first conductive unit.

A difference between a minimum spacing-distance from a boundary surface of the through-hole to the upper coil and a minimum spacing-distance from the boundary surface of the through-hole to the lower coil may be smaller than a minimum line width of each of the plurality of conductive units of the internal coil.

At least one of the plurality of conductive units surrounding the first conductive unit may have a neck region in which a line width thereof is narrow relative to a width of another region of the at least one of the plurality of conductive units.

The neck region may be a region of one section in which the number of turns of the conductive units is X ($X \geq 2$), and the another region may be a region of another section in which the number of turns of the conductive units is $X-1$.

The neck region may be disposed in a curved portion of the at least one conductive unit.

The plurality of conductive units may be insulated from each other by an insulator disposed between the plurality of conductive units.

The insulator may include openings having a shape corresponding to the internal coil, and the openings may be filled with the internal coil.

The number of conductive units included in the upper coil may be n, and turns of the upper coil may be n.

An entire line width occupied by the n conductive units in one section may be the same as that occupied by $n-1$ conductive units in another section, on an upper surface of the support member.

The number of conductive units included in the lower coil may be m, and turns of the lower coil may be m.

An entire line width occupied by the m conductive units in one section may be the same as that occupied by $m-1$ conductive units in another section, on a lower surface of the support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure will be described. However, the present disclosure is not limited thereto.

Figure 1:
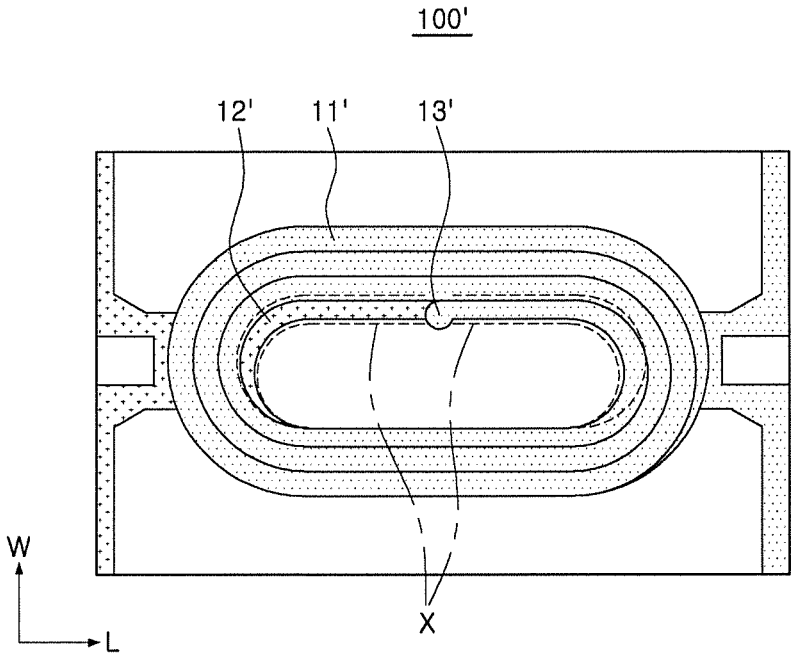
FIG. 1 is a schematic plan view illustrating internal coils of a coil component according to the related art.

FIG. 1 is a schematic plan view illustrating internal coils of a coil component 100' according to the related art. In the coil component according to the related art, when a via 13' connecting an upper coil 11' and a lower coil 12' to each other is formed, the upper and lower coils may be arranged asymmetrically to each other. Such an asymmetry between the upper and lower coils, an unusable area X that does not contribute to a magnetic permeability of the coil component may be inevitably generated as an internal area of a magnetic material filled in the vicinity of a core center adjacent to the via. Therefore, there may be a limitation in improving characteristics of the coil component such as an inductance (Ls) and Isat characteristics.

A coil component according to the present disclosure is derived in order to solve the abovementioned problem of the coil component according to the related art.

Figure 2:
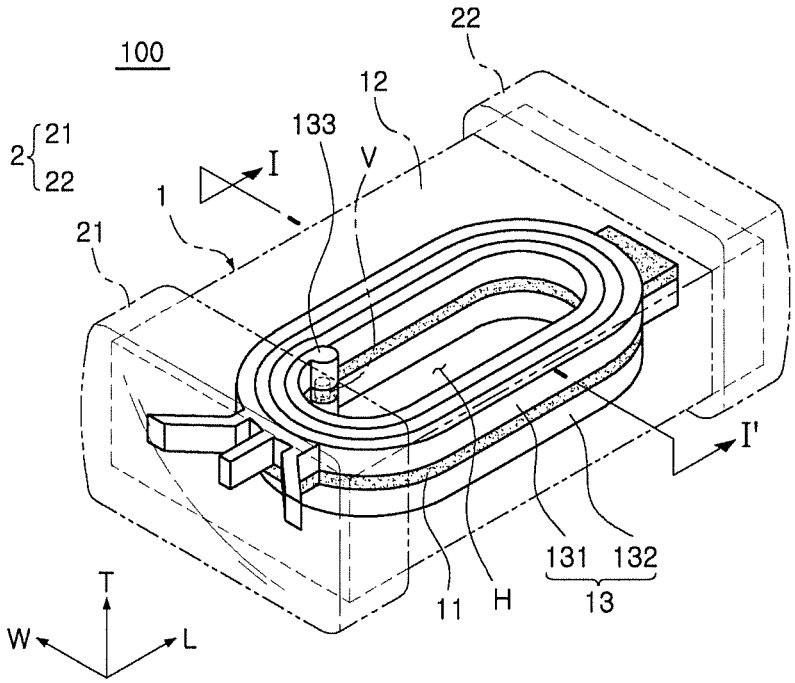
FIG. 2 is a schematic perspective view illustrating a coil component according to an exemplary embodiment in the present disclosure.
Figure 3:
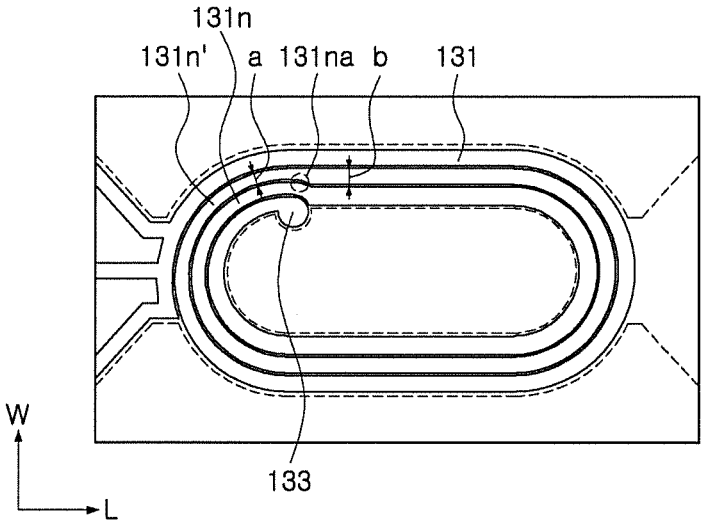
FIG. 3 is a plan view of FIG. 2 when viewed from the top.
Figure 4:
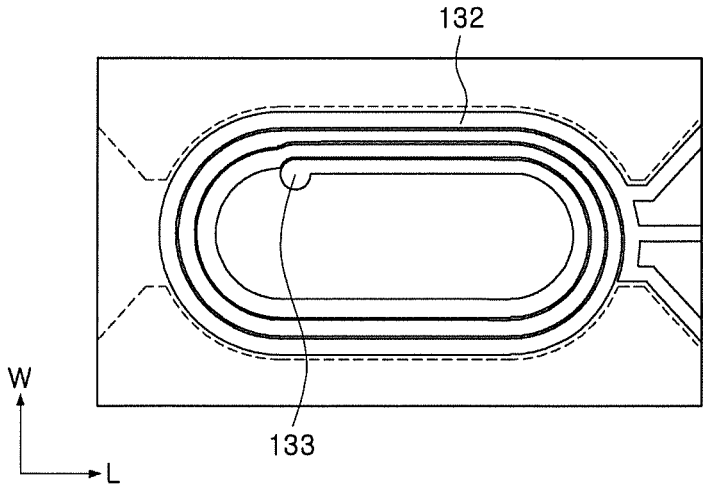
FIG. 4 is a plan view of FIG. 2 when viewed from the bottom.

FIG. 2 is a schematic perspective view illustrating a coil component according to an exemplary embodiment in the present disclosure, FIG. 3 is a plan view of FIG. 2 when viewed from the top, and FIG. 4 is a plan view of FIG. 2 when viewed from the bottom.

Referring to FIGS. 2 through 4, a coil component 100 according to an exemplary embodiment in the present disclosure may include a body 1 and an external electrode 2 disposed on an external surface of the body.

The body 1 may have a first end surface and a second end surface opposing each other in a length (L) direction, a first side surface and a second side surface opposing each other in a width (W) direction, and an upper surface and a lower surface opposing each other in a thickness (T) direction to substantially have a hexahedral shape.

The body 1 may include a support member 11. The support member 11 may serve to facilitate formation of an internal coil and support the internal coil. The support member may be formed of a thin plate having an insulation property, for example, a thermosetting resin such as an epoxy resin, a thermoplastic resin such as a polyimide resin, or a resin having a reinforcement material such as a glass fiber or an inorganic filler impregnated in the thermosetting resin and the thermoplastic resin. In detail, any known copper clad laminate (CCL) substrate, an Ajinomoto build-up film (ABF), FR-4, bismaleimide triazine (BT) resin, a photoimagable dielectric (PID) resin, or the like, may be used as a material of the support member 11.

The support member 11 may include a through-hole H and a via hole v. The through-hole may be formed substantially in a central portion of the support member 11, and the via hole v may be formed to be spaced apart from the through-hole H by a predetermined distance. The through-hole H may be filled with an encapsulant 12 formed of a magnetic material to serve to increase a magnetic permeability of the coil component 100. Therefore, when a cross-sectional area of the through-hole is increased, the magnetic permeability may be increased, but there may be a limitation in increasing the cross-sectional area of the through-hole in a miniaturized coil component.

Meanwhile, since the via hole v serves to connect an upper coil and a lower coil to each other, the via hole v may be filled with a conductive material to form a via portion 133 to be described below.

The through-hole of the support member 11 may be filled with the encapsulant 12. The encapsulant 12 may encapsulate the support member 11 and the internal coil to substantially determine an appearance of the coil component. The encapsulant 12 may have a magnetic property, and may include a magnetic material and a resin. The magnetic material may be any material having the magnetic property, for example, ferrite or metal magnetic particles. The metal magnetic particles may include specifically iron (Fe), chromium (Cr), aluminum (Al), or nickel (Ni), but are not limited thereto.

The body 1 may include the support member 11 and the internal coil 13 supported by the support member 11 together with the encapsulant 12 and encapsulated by the encapsulant 12. The internal coil 13 may generally be configured in a spiral shape. The internal coil 13 may have a structure that may remove the unusable area X described with reference to FIG. 1.

The internal coil 13 may include an upper coil 131 disposed on one surface of the support member 11 and a lower coil 132 disposed on the other surface of the support member. The upper and lower coils 131 and 132 may be connected to each other through the via portion 133. The via portion 133 may connect one end portion of the upper coil 131 and one end portion of the lower coil 132 to each other. For reference, the other end portion of the upper coil 131 that is not connected to the via portion 133 may be exposed to the first end surface of the body to thus be connected to a first external electrode 21, and the other end portion of the lower coil 132 that is not connected to the via portion 133 may be exposed to the second end surface of the body to be thus connected to a second external electrode 22.

Referring to FIGS. 3 and 4, each of the upper and lower coils 131 and 132 may include a plurality of conductive units wound in one direction. The number of conductive units in the upper coil 131 may be n, and the upper coil 131 may have a form in which n conductive units are wound n times. Likewise, the number of conductive units in the lower coil 132 may be m, and the lower coil 132 may have a form in which m conductive units are wound m times. The plurality of conductive units may be continuously connected to each other without having a boundary surface therebetween to generally have a spiral shape. Here, n or m may be appropriately selected depending on turns of coils desired by those skilled in the art, and in the coil component illustrated in FIGS. 2 through 4, the sum of n and m may be 6.5.

Referring to FIG. 3, when a conductive unit directly surrounding the via portion 133 is a first conductive unit 131*n*, an outer boundary surface of the first conductive unit 131*n* may include a protrusion portion 131*na* protruding toward the external surface of the body 1. Here, the conductive unit directly surrounding the via portion 133 does not refer to a conductive unit in direct contact with the via portion 133, and refers to a conducive unit that is insulated from the via portion through an insulator (e.g., an insulator 14 in FIG. 5), but is wound to be closest to the via portion 133 among the plurality of conductive units. The protrusion portion may be configured to include a boundary surface that substantially corresponds to an outer boundary surface of the via portion 133. Since the via portion has a structure in which it is embedded into an internal coil toward an outer portion of the internal coil, the first conductive unit surrounding the via portion may have a structure in which it protrudes toward the outer portion of the internal coil, that is, the external surface of the body.

In addition, a second conductive unit 131*n*' of the plurality of conductive units constituting the upper coil may surround the first conductive unit, and may have a neck region in which a line width "a" thereof is narrowed, as compared to a width "b" of another region of the at least one of the plurality of conductive units. The neck region may be a region of one section in which the number of turns of the conductive units is X (X≥2). The another region may be a region of another section in which the number of turns of the conductive units is X−1. Formation of a protrusion portion in the outermost conductive unit of the internal coil may be prevented due to the neck region. A case in which the neck region is formed in the second conductive unit is illustrated, but the neck region is not is not limited thereto. That is, those skilled in the art may appropriately adjust a position of the neck region depending on the number of conductive units. In addition, only one neck region is not present, and a neck region may be included in each of the plurality of conductive units.

In each of the plurality of conductive units, linear portions and curved portions may be alternately disposed. The liner portions and the curved portions may be connected to each other to constitute one conductive unit.

The via portion 133 may be disposed in the curved portion of the linear portion and the curved portion of the conductive unit. This may be to significantly decrease a change in a line width of the conductive unit. Resultantly, a change in Rdc characteristics may be significantly decreased.

However, the via portion 133 is not limited to being formed at only a position illustrated in FIG. 3, and may be formed in a range of a position spaced from the position illustrated in FIG. 3 by +/−¼ turn (here, + refers to a winding direction of the conductive unit, and − refers to an opposite direction to the winding direction of the conductive unit).

Meanwhile, the lower coil 132 illustrated in FIG. 4 is different from the upper coil 131 illustrated in FIG. 3, but may include components that are substantially the same as those of the upper coil 131. Therefore, an overlapping description for the lower coil will be omitted.

Figure 5:
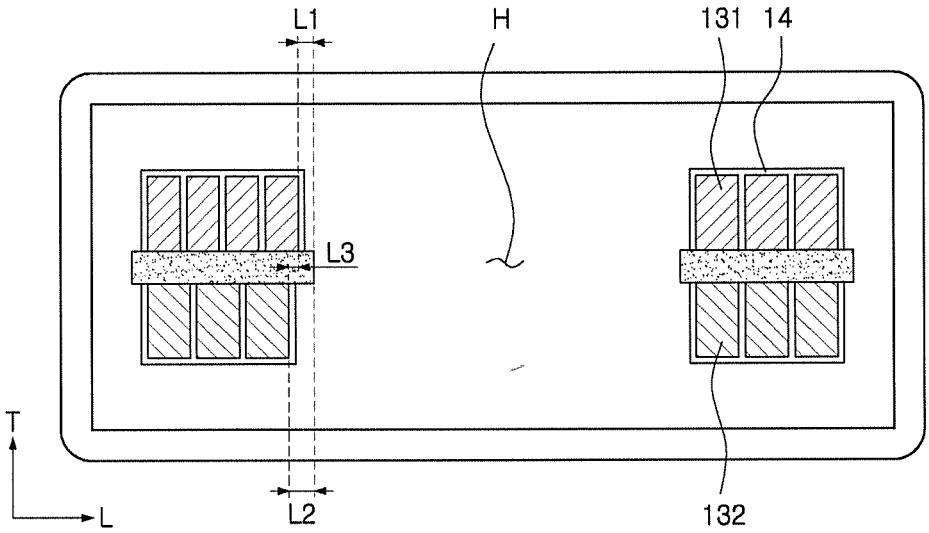
FIG. 5 is a cross-sectional view taken along line I-I' of FIG. 2.

FIG. 5 is a cross-sectional view taken along line I-I' of FIG. 2. Referring to FIG. 5, a difference L3 between a minimum spacing-distance L1 from a boundary surface of the through-hole H to the upper coil 131 and a minimum spacing-distance L2 from the boundary surface of the through-hole H to the lower coil 132 may be smaller than a minimum line width of one conductive unit. In this case, in the coil component according to the related art, a difference between a minimum spacing-distance from a boundary surface of the support member to the upper coil and a minimum spacing-distance from the boundary surface of the support member to the lower coil may be the same as or greater than a line width of a conductive unit of the internal coil due to formation of the via. However, in the coil component according to the present disclosure, the difference may be substantially removed through a structure in which the via portion is embedded into the internal coil. Resultantly, an encapsulant filling region of a core center may be significantly increased. Meanwhile, although not illustrated in detail, it may be most preferable that L1 and L2 are the same as each other, such that the innermost side surface of the upper coil and the innermost side surface of the lower coil are arranged on the same line. In other words, when the number of conductive units included in the upper coil is n, a section in which an entire line width occupied by the n conductive units is the same as another section occupied by n−1 conductive units, on the upper surface of the support member, may be formed on the upper surface of the support member. Likewise, when the number of conductive units included in the lower coil is m, a section in which an entire line width occupied by the m conductive units is the same as another section occupied by m−1 conductive units, on the lower surface of the support member, may be formed on the lower surface of the support member.

Referring to FIG. 5, the internal coil may be in contact with an insulator 14. The insulator 14 may serve to insulate adjacent conductive units from each other. The insulator 14 may include openings having a shape corresponding to the internal coil, and the openings may be filled with the internal coil. A method of forming the openings of the insulator 14 is not limited. As an example, the openings may be formed as patterns of the internal coil in an insulating material having a predetermined thickness using a $CO_2$ laser beam. Then, a plating material may be filled in the openings by a plating process to form the internal coil, and a separate insulating sheet covering upper surfaces of the insulating material and the internal coil may be attached or the entirety of the insulating material may be removed using a laser beam and a separate insulator may thus be coated by a chemical vapor deposition (CVD) process. When a manner of patterning the insulating material is used as described above, a width of the opening may be controlled to control a line width of the conductive unit of the internal coil filled in the opening. As a result, a coil component having a coil structure different from that of FIG. 1 may be derived.

Table 1 illustrates comparison results between characteristics of the coil component (Inventive Example 1) illustrated in FIGS. 2 through 5 and characteristics of the coil component (Comparative Example 1) illustrated in FIG. 1. The coil components according to Inventive Example 1 and Comparative Example 1 may be applied to a 1608 0.65T type.

TABLE 1

| | | Electrical Characteristics | | | | |
|---|---|---|---|---|---|---|
| | Turns of | 1 Mhz | | | | |
| Sample | Designed Coil | Ls [μH] | Q | Rs [Ohm] | Rdc [mOhm] | DC Bias [A] |
| Inventive Example 1 | 6.5Turn | 0.50 | 28.5 | 0.110 | 53.5 | I 3.8<br>N 4.1 |
| Comparative Example 1 | 6.5Turn | 0.47 | 26.9 | 0.109 | 49.2 | I 3.4<br>N 3.2 |

It may be appreciated from Table 1 that inductance Ls and Q characteristics are improved by 10% in Inventive Example 1 as compared to Comparative Example 1 including the same turns of the coil. In Inventive Example 1, it is considered that a magnetic material filling space of the core center of the internal coil is increased, such that an effect of an inductance increase is exhibited.

As set forth above, according to the exemplary embodiment in the present disclosure, the coil component in which the magnetic material filling space of the core center is secured as much as possible by changing a coil structure in the vicinity of the via may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a support member including a through-hole and a via hole spaced apart from the through-hole, an internal coil supported by the support member and including a plurality of conductive units wound in one direction, and an encapsulant encapsulating the support member and the internal coil and disposed in the through-hole; and an external electrode connected to the internal coil, wherein the internal coil includes an upper coil disposed on one surface of the support member and a lower coil disposed on the other surface of the support member and includes a via portion connecting end portions of the upper and lower coils to each other and disposed in the via hole, a first conductive unit, among the plurality of conductive units, as a turn of the internal coil surrounding the via portion, includes an outer boundary surface having a protrusion portion protruding toward an external surface of the body, and the protrusion portion has a shape corresponding to a portion of an outer surface of the via portion surrounded by the protrusion portion.

2. The coil component of claim 1, wherein each of the plurality of conductive units includes linear portions and curved portions alternately disposed and connected to each other.

3. The coil component of claim 2, wherein the via portion is disposed in the curved portion of the plurality of conductive units.

4. The coil component of claim 1, wherein the via portion is embedded toward the protrusion portion of the first conductive unit.

5. The coil component of claim 1, wherein a difference between a minimum spacing-distance from a boundary surface of the through-hole to the upper coil and a minimum spacing-distance from the boundary surface of the through-hole to the lower coil is smaller than a minimum line width of each of the plurality of conductive units of the internal coil.

6. The coil component of claim 1, wherein at least one of the plurality of conductive units surrounding the first conductive unit has a neck region in which a line width thereof is narrow relative to a width of another region of the at least one of the plurality of conductive units.

7. The coil component of claim 6, wherein the neck region is a region of one section in which the number of turns of the conductive units is X ($X \geq 2$), in the one section, the plurality of conductive units include curved portions, the another region is a region of another section in which the number of turns of the conductive units is $X-1$, and in the another section, the plurality of conductive units include linear portions.

8. The coil component of claim 6, wherein the neck region is disposed in a curved portion of the at least one conductive unit.

9. The coil component of claim 1, wherein the plurality of conductive units are insulated from each other by an insulator disposed between the plurality of conductive units.

10. The coil component of claim 9, wherein the insulator includes openings having a shape corresponding to the internal coil, and the openings are filled with the internal coil.

11. The coil component of claim 1, wherein the number of conductive units included in the upper coil is n, and turns of the upper coil is n.

12. The coil component of claim 11, wherein an entire line width occupied by the n conductive units in one section is the same as that occupied by $n-1$ conductive units in another section, on an upper surface of the support member.

13. The coil component of claim 1, wherein the number of conductive units included in the lower coil is m, and turns of the lower coil is m.

14. The coil component of claim 13, wherein an entire line width occupied by the m conductive units in one section is the same as that occupied by $m-1$ conductive units in another section, on a lower surface of the support member.

15. The coil component of claim 1, wherein the shape of the protrusion portion is conformal with respect to the portion of the outer surface of the via portion surrounded by the protrusion portion.

16. A coil component comprising:

a body including a support member including a through-hole and a via hole spaced apart from the through-hole, an internal coil supported by the support member and including a plurality of conductive units wound in one direction, and an encapsulant encapsulating the support member and the internal coil and disposed in the through-hole; and an external electrode connected to the internal coil, wherein the internal coil includes an upper coil disposed on one surface of the support member and a lower coil disposed on the other surface of the support member and includes a via portion connecting end portions of the upper and lower coils to each other and disposed in the via hole, a first conductive unit, among the plurality of conductive units, as a turn of the internal coil surrounding the via portion, includes an outer boundary surface having a protrusion portion protruding toward an external surface of the body, the protrusion portion surrounds the via portion, and a portion of the first conductive unit having the protrusion portion has a line width narrower than a line width of another portion of the first conductive unit extending from the portion.

17. The coil component of claim 16, wherein each of the plurality of conductive units includes linear portions and curved portions alternately disposed and connected to each other.

18. The coil component of claim 17, wherein the via portion is disposed in the curved portion of the plurality of conductive units.

19. A coil component comprising:

a body including a support member including a through-hole and a via hole spaced apart from the through-hole, an internal coil supported by the support member and including a plurality of conductive units wound in one direction, and an encapsulant encapsulating the support member and the internal coil and disposed in the through-hole; and an external electrode connected to the internal coil, wherein the internal coil includes an upper coil disposed on one surface of the support member and a lower coil disposed on the other surface of the support member and includes a via portion connecting end portions of the upper and lower coils to each other and disposed in the via hole, a first conductive unit, among the plurality of conductive units, as a turn of the internal coil surrounding the via portion other than an outermost turn of the internal coil, includes an outer boundary surface having a protrusion portion protruding toward an external surface of the body, and the protrusion portion surrounds the via portion.

20. The coil component of claim 19, wherein each of the plurality of conductive units includes linear portions and curved portions alternately disposed and connected to each other, and the via portion is disposed in the curved portion of the plurality of conductive units.

* * * * *